US010317087B2

(12) United States Patent
Chadwick et al.

(10) Patent No.: US 10,317,087 B2
(45) Date of Patent: Jun. 11, 2019

(54) SELF-ADJUSTING BURNER IGNITER FOR GAS COOKTOPS

(71) Applicants: BSH Home Appliances Corporation, Irvine, CA (US); BSH Hausgeräte GmbH, Munich (DE)

(72) Inventors: Temple Chadwick, New Bern, NC (US); Benjamin Knight, New Bern, NC (US); Brandon Kornegay, New Bern, NC (US); Kevin W. Sherbert, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 255 days.

(21) Appl. No.: 15/095,201

(22) Filed: Apr. 11, 2016

(65) Prior Publication Data

US 2017/0292710 A1 Oct. 12, 2017

(51) Int. Cl.
*F24C 3/08* (2006.01)
*F24C 3/10* (2006.01)

(52) U.S. Cl.
CPC ..... *F24C 3/082* (2013.01); *F24C 3/085* (2013.01); *F24C 3/103* (2013.01)

(58) Field of Classification Search
CPC ..... F24C 3/082; F24C 3/103; F24C 3/085
USPC ..... 431/130, 129, 259, 254, 142, 143, 132, 431/263, 264
See application file for complete search history.

(56) References Cited

U.S. PATENT DOCUMENTS

| | | | | |
|---|---|---|---|---|
| 5,836,756 | A | 11/1998 | Moss | |
| 5,924,860 | A * | 7/1999 | Massey | F24C 3/103 126/39 E |
| 6,015,322 | A * | 1/2000 | White | F23Q 3/008 264/618 |
| 6,589,046 | B2 | 7/2003 | Harneit | |
| 7,850,447 | B1 | 12/2010 | Wylie et al. | |
| 2014/0377711 | A1 | 12/2014 | Blalock et al. | |

FOREIGN PATENT DOCUMENTS

| | | | | |
|---|---|---|---|---|
| EP | 2267371 | A2 | 12/2010 | |
| EP | 2439454 | A1 * | 4/2012 | F24C 3/085 |
| JP | S61130733 | A | 6/1986 | |
| KR | 20010090284 | A | 10/2001 | |

* cited by examiner

*Primary Examiner* — Avinash A Savani
*Assistant Examiner* — Rabeeul I Zuberi
(74) *Attorney, Agent, or Firm* — Michael E. Tschupp; Andre Pallapies; Brandon G. Braun

(57) ABSTRACT

A burner assembly for a domestic gas cooktop includes a lower burner mounting structure positioned on a first side of the top sheet; a burner body configured to be positioned on an opposite side of the top sheet, the burner body having an igniter positioning surface; an igniter having an igniter end, and a stop integrally formed in the igniter, the stop having an upper ledge; and an urging member that pushes against the lower burner mounting structure, and urges the igniter in a direction away from the lower burner mounting structure and toward the igniter positioning surface such that the upper ledge of the stop is urged into contact with the igniter positioning surface when the burner assembly is in an assembled condition. The igniter is held in an operating position by the burner body and the urging member when the burner assembly is in use.

18 Claims, 7 Drawing Sheets

SELF-ADJUSTING BURNER IGNITER FOR GAS COOKTOPS

FIELD OF THE INVENTION

The invention is directed to an apparatus and method related to properly positioning the igniter in a burner of a gas cooktop.

An example of an application for the invention is a domestic kitchen gas cooktop having an improved burner igniter locating structure.

BACKGROUND OF THE INVENTION

Some modern domestic kitchens include a gas cooktop as either a countertop mounted cooktop or as a part of a standalone range.

In some domestic appliances, such as a gas cooktop, an igniter is used to create a spark between the igniter and another part of the cooktop to light the gas supplied to the burner. For example, an igniter can create a spark in a gap between the igniter and a metallic burner head that is positioned on the top of the burner body. The consistency and reliability of the creation of the gap and, as a result, the spark is instrumental in reliable and consistent lighting and relighting of the burner.

With some igniter configurations, it can be difficult to accurately locate the igniter such that the size of the gap is within design parameters. This difficulty can result from how the igniter is held in place and to what part of the cooktop the igniter is attached. Certain attachment methods, especially those that attach the igniter to the burner body, can also present difficulties during assembly in that it is necessary to hold the top sheet of the cooktop above, and in close proximity to, the lower portion of the cooktop so that wires can be connected to the igniter. This can be especially difficult if the cooktop has multiple, such as five or six, burners. This operation can often require two assembly workers to complete.

Some igniters are held in position by a friction fit into a bracket that is fastened to a burner body. This attachment method can be problematic because the friction fit can wear over time, possibly resulting in an improper spark gap and associated inconsistent lighting of the burner.

Applicants recognized these problems and developed a solution as described herein.

SUMMARY

The invention achieves the benefit of more precise and repeatable igniter placement and simpler assembly. The invention achieves this benefit by providing an igniter that is attached to the lower burner mounting structure below the top sheet. The igniter is attached to the lower burner mounting structure using a spring or other urging member that pushes the igniter toward the burner body. The igniter is captured such that it will stay attached to the lower burner mounting structure even without the top sheet in place. The igniter includes a stop that provides a ledge for the urging member on its lower side and a ledge that is pressed down by an underside of the burner body when the burner body and top sheet are lowered into an operating position. Because the igniter is located in the operating position by a surface-to-surface engagement with the burner body itself by being pressed into position by the urging member (and not a friction fit that can move over time), the igniter head is more precisely and repeatably positioned. In addition, because the igniter is captured by the lower burner mounting structure and held in place before the top sheet (and associated burner body) is lowered into position, the igniter wiring can be attached to the igniter without having to hold the top sheet.

Particular embodiments of the invention are directed to a burner assembly for a domestic gas cooktop having a top sheet. The burner assembly includes a lower burner mounting structure configured to be positioned on a first side of the top sheet; a burner body configured to be positioned on a second side of the top sheet, the second side of the top sheet being opposite the first side of the top sheet, the burner body having an igniter positioning surface; an igniter having an igniter end, and a stop integrally formed in the igniter, the stop having an upper ledge; and an urging member that pushes against the lower burner mounting structure, and urges the igniter in a direction away from the lower burner mounting structure and toward the igniter positioning surface of the burner body such that the upper ledge of the stop is urged into contact with the igniter positioning surface of the burner body when the burner assembly is in an assembled condition. The igniter is held in an operating position by the burner body and the urging member when the burner assembly is in use.

Other embodiments of the invention are directed to a domestic gas cooktop. The domestic cooktop includes a top sheet; a gas manifold below the top sheet; and a burner assembly having a lower burner mounting structure positioned on a first side of the top sheet, a burner body positioned on a second side of the top sheet, the second side of the top sheet being opposite the first side of the top sheet, the burner body having an igniter positioning surface, an igniter having an igniter end and a stop integrally formed in the igniter, the stop having an upper ledge, and an urging member that pushes against the lower burner mounting structure and urges the igniter in a direction away from the lower burner mounting structure and toward the igniter positioning surface of the burner body such that the upper ledge of the stop is urged into contact with the igniter positioning surface of the burner body when the burner assembly is in an assembled condition. The igniter is held in an operating position by the burner body and the urging member when the domestic gas cooktop in use.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

Figure 1:
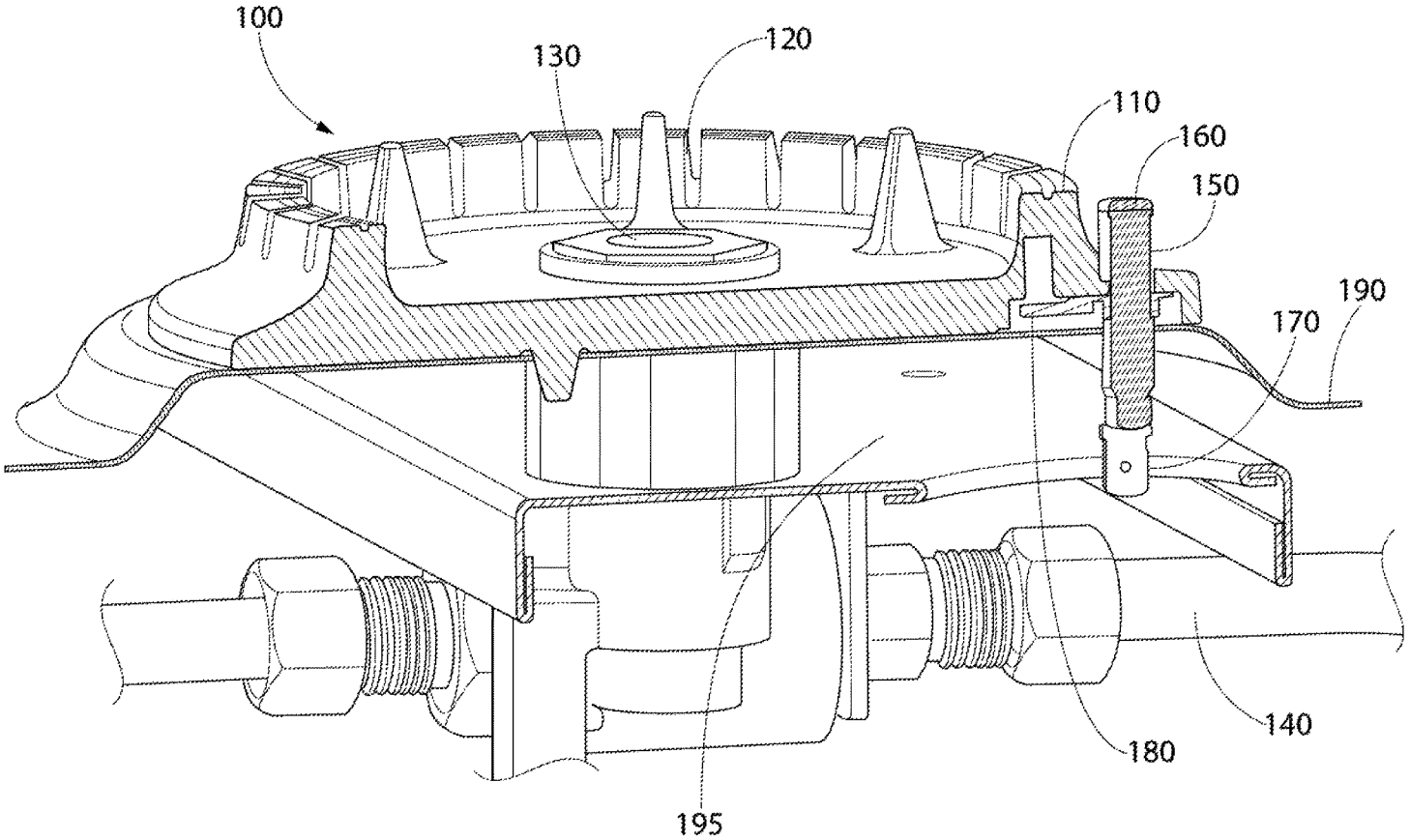
FIG. 1 is a partial sectional view of a cooktop having a friction fit igniter attached to a burner body.

The invention is described herein with reference to the accompanying drawings in which exemplary embodiments of the invention are shown. The invention may, however, be embodied in many different forms and should not be construed as limited to the embodiments set forth herein.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise.

As explained above, embodiments of the invention provide a solution to the problems associated with an igniter attached to a burner body.

Figure 2:
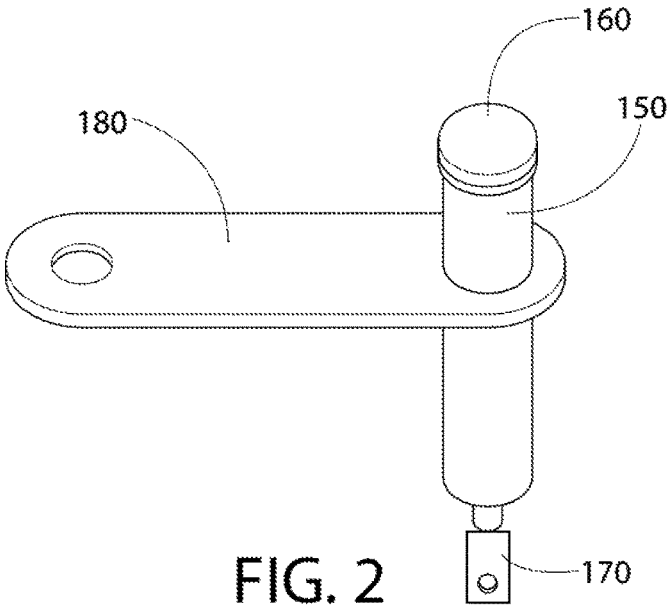
FIG. 2 is a perspective view of a friction fit igniter for attaching to a burner body.
Figure 3:
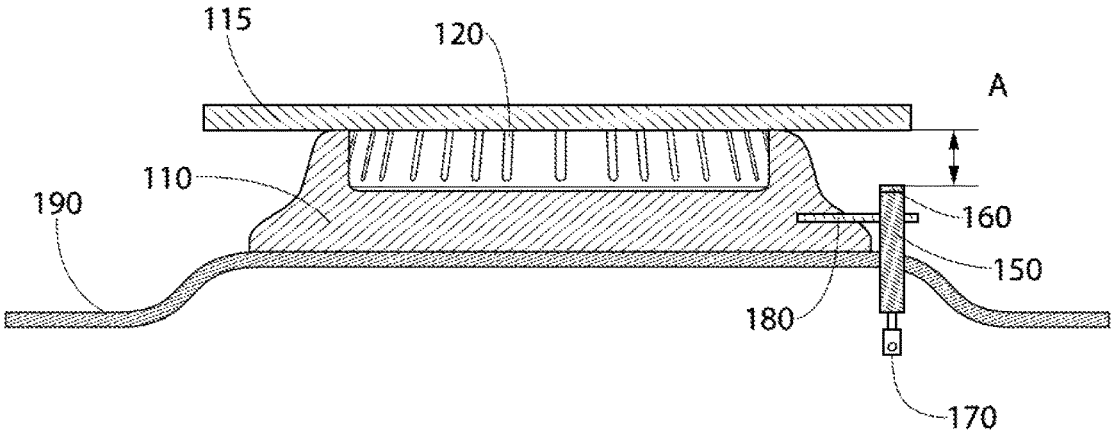
FIG. 3 is a partial sectional view of the cooktop having a friction fit igniter attached to a burner body.

FIGS. 1-3 show an example of a burner assembly 100 that is part of a gas cooktop. Some cooktops have a plurality of burner assemblies 100. In this example, burner assembly 100 has a metal burner body 110 that has a plurality of flame apertures 120. Although a metal burner body is shown, other temperature resistant materials can be used. A metal burner head 115 (shown in FIG. 3) sits on top of burner body 110. Although a metal burner head is shown, other temperature resistant materials can be used. Gas supplied through a gas supply line 140 travels through a gas valve that controls the flow of gas to burner assembly 100. The gas then travels through a venturi and out of a gas outlet 130. The gas then escapes through flame apertures 120, where it is lit by a sparking or other lighting device. In this example, an igniter 150 creates a spark across gap A between an igniter head 160 and burner head 115. It is noted that gap A shown in FIG. 3 is not necessarily to scale and the proper gap distance depends on factors such as, for example, igniter power, igniter material, and burner head material.

In this example, gas supply line 140 and the gas valve are positionally fixed relative to a lower burner mounting structure 195. Burner body 110 is mounted to a top sheet 190 of the cooktop. Top sheet 190 can be a piece of sheet material, such as, for example, sheet metal, that forms the main surface that is seen by the user when the cooktop is in use.

As shown in FIG. 2, igniter 150 has an igniter head 160 at one end and an igniter electrical connection 170 at the opposite end. Igniter 150 is press fit into a hole in an igniter mounting bracket 180. As shown in FIGS. 1 and 3, igniter mounting bracket 180 is attached to burner body 110. The location of igniter head 160 relative to burner head 110, and therefore burner head 115, is initially fixed once igniter mounting bracket 180 is attached to burner body 110. In this example, igniter mounting bracket 180 is held to burner body 110 by a bolt or other fastener. Spark gap A is determined by the position of igniter head 160 relative to burner head 115, as shown in FIG. 3. The press fit connection between igniter 150 and igniter mounting bracket 180 can lead either initially, or over time, to an incorrect spark gap that can result in inconsistent lighting of the burner. In addition, the connection of igniter mounting bracket 180 to burner body 110 and the possible distortion of igniter mounting bracket 180 can lead to an incorrect spark gap.

The designs shown in FIGS. 1-3 also present difficulties during assembly in that it is necessary to hold the top sheet of the cooktop above, and in close proximity to, the lower structure of the cooktop so that wires can be connected to the igniter. This can be especially difficult if the cooktop has multiple, such as five or six, burners. This operation can often require two assembly workers to complete Applicants recognized these shortcomings of the designs shown in FIGS. 1-3 and developed embodiments of the invention to avoid these problems.

Figure 4:
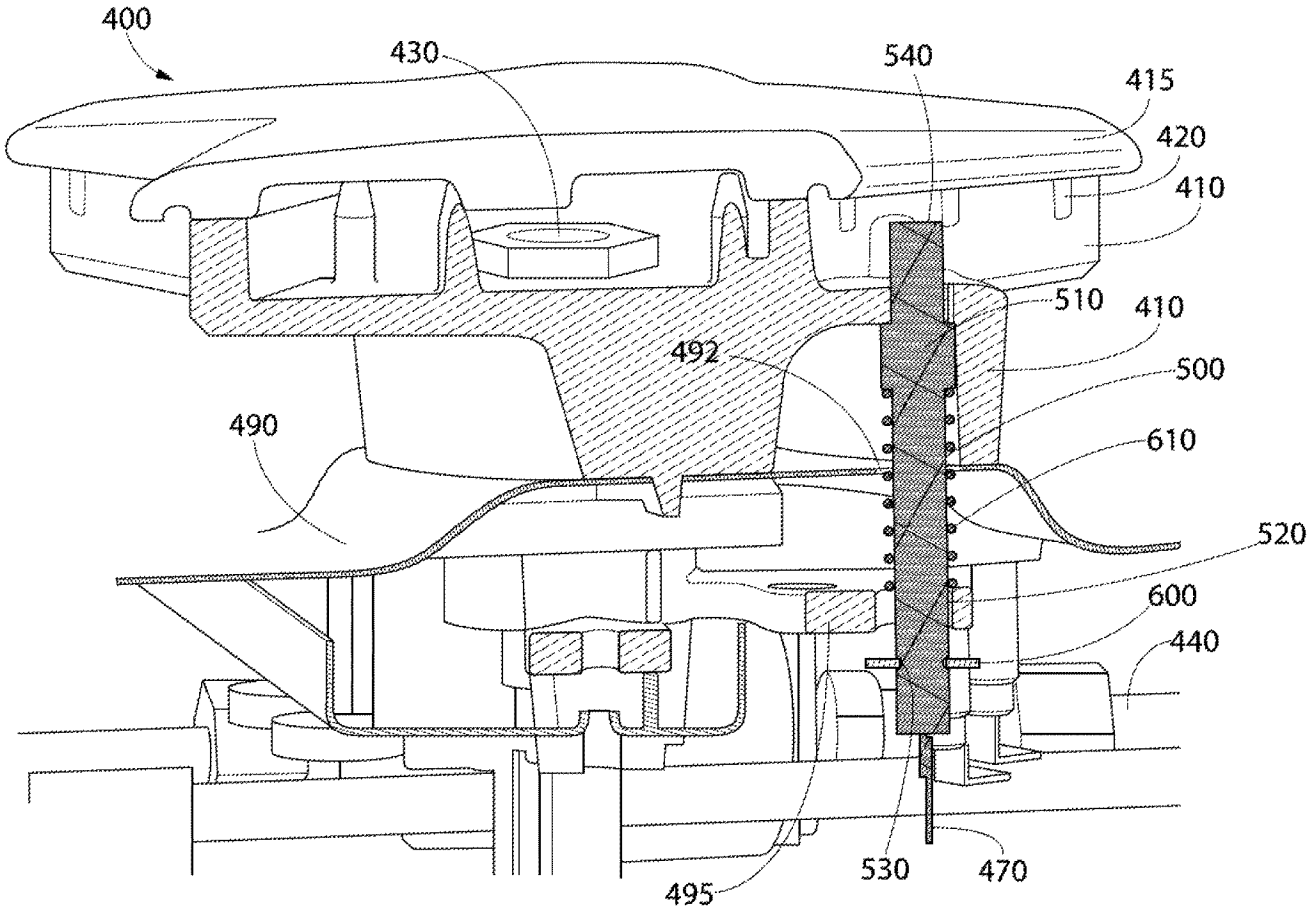
FIG. 4 is a partial sectional view of a cooktop in accordance with embodiments of the invention.

FIG. 4 shows an exemplary embodiment having an igniter that is attached to the lower burner mounting structure and is urged into place by a spring.

FIG. 4 shows a burner assembly 400 that is part of a gas cooktop. Some cooktops have a plurality of burner assemblies 400. In this example, burner assembly 400 has a metal burner body 410 that has a plurality of flame apertures 420. Although a metal burner body is shown, other temperature resistant materials can be used. A metal burner head 415 sits on top of burner body 410. Although a metal burner head is shown, other temperature resistant materials can be used. Gas supplied through a gas supply line 440 travels through a gas valve that controls the flow of gas to burner assembly 400. The gas then travels through a venturi and out of a gas outlet 430. The gas then escapes through flame apertures 420, where it is lit by a sparking or other lighting device. In this example, an igniter 500 creates a spark across a gap between a top 540 of igniter 500 and burner head 415. It is noted that the gap shown in FIG. 4 is not necessarily to scale and the proper gap distance depends on factors such as, for example, igniter power, igniter material, and burner head material.

In this example, gas supply line 440 and the gas valve are positionally fixed relative to a lower burner mounting structure 495. Burner body 410 is mounted to a top sheet 490 of the cooktop. Top sheet 490 can be a piece of sheet material, such as, for example, sheet metal, that forms the main surface that is seen by the user when the cooktop is in use.

Figure 5:
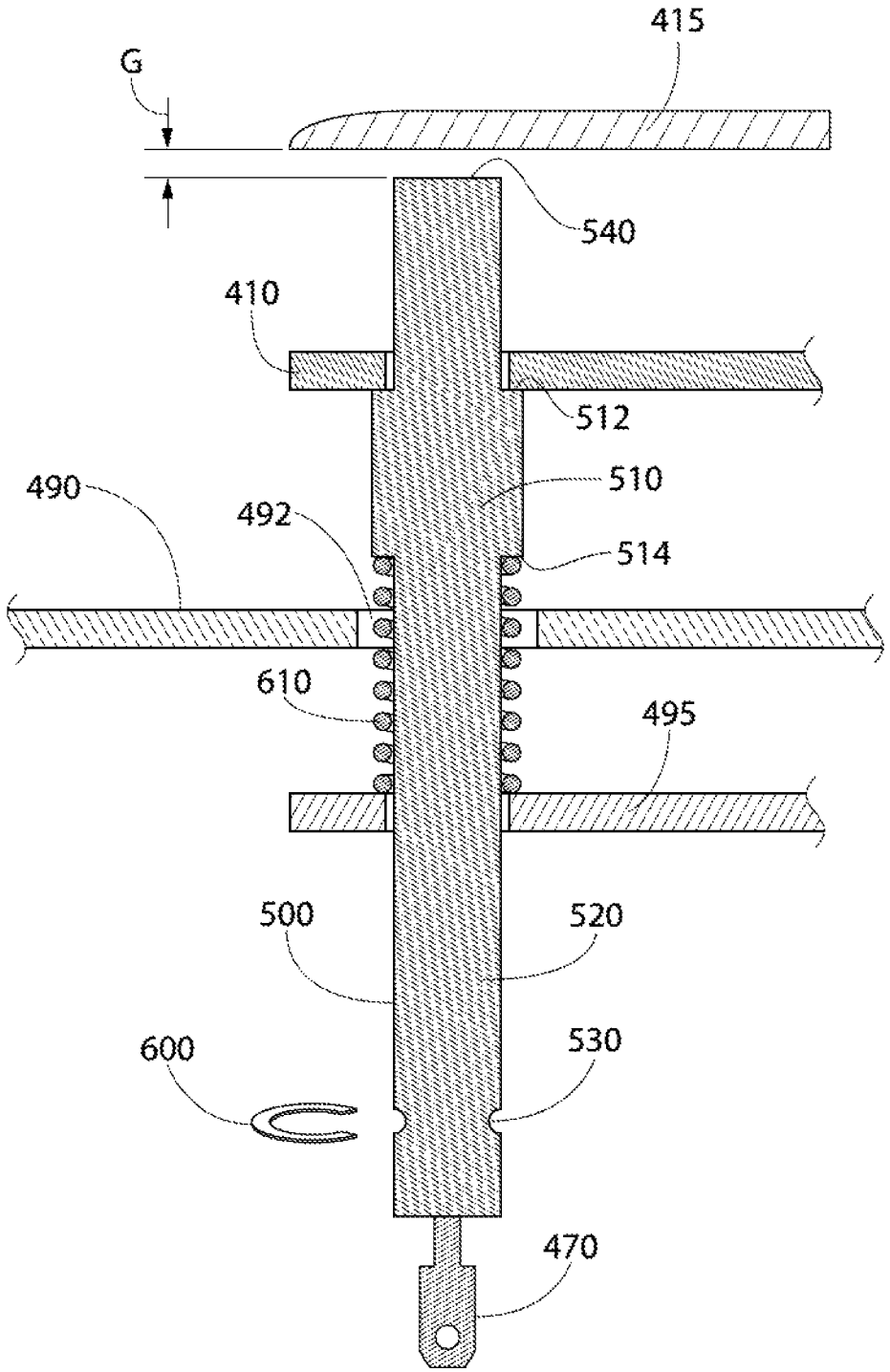
FIG. 5 is a partial sectional view of a cooktop in accordance with embodiments of the invention.

Igniter 500 is shown in this example as a one-piece igniter having a stop 510 formed in its main body 520. FIG. 5 shows igniter 500 when burner assembly 400 is in an assembled condition. In this condition, top 540 of igniter 500 extends through a hole in burner body 410, and an upper ledge 512 of stop 510 is pushed up against a lower surface of burner body 410. Igniter 500 is pushed upward by a spring 610 acting on a lower ledge 514 of stop 510 and an upper surface of lower burner mounting structure 495. Spring 610 pushes igniter 500 upward into a repeatable position relative to burner body 410. Although a coil spring is shown in this example, other urging members can be used to push igniter toward burner body 410. The positional relationship of burner head 415 relative to burner body 410 is fixed (even though burner head 415 is removable from burner body 410) because burner head 415 and burner body 410 are made from dimensionally stable materials and have defined connection points. Due to this stability in the relative position of burner body 410 and burner head 415, a spark gap G between top 540 of igniter 500 and burner head 415 is precise and repeatable. In this example, top 540 of igniter 500 is directly vertically below burner head 415.

Also shown in FIG. 5 is top sheet 490 and a hole 492 in top sheet 490 through which igniter 500 passes during assembly of top sheet 490 to the cooktop lower structure. Hole 492 is large enough for stop 510 and spring 610 to pass through hole 492 during assembly of top sheet 490 to the cooktop lower structure. Igniter 500 also has an electrical connection 470 to which wires are attached to provide power and/or control to igniter 500. A groove 530 exists in main body 520 to receive a clip 600. Clip 600 prevents spring 610 from pushing igniter 500 out of lower burner mounting structure 495 when top sheet 490 is not in the operating position. Although a clip and a groove are shown in this example, other retaining structures can be used to prevent movement of igniter 500 relative to lower burner mounting structure 495.

Figure 6:
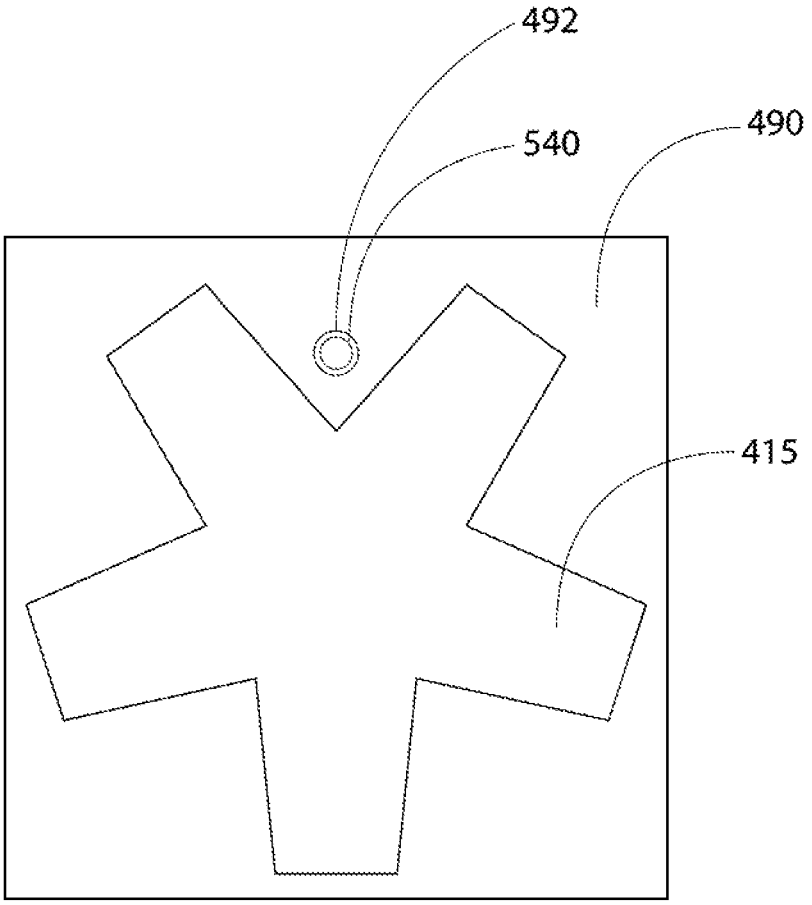
FIG. 6 is a partial plan view of a cooktop in accordance with embodiments of the invention.
Figure 7:
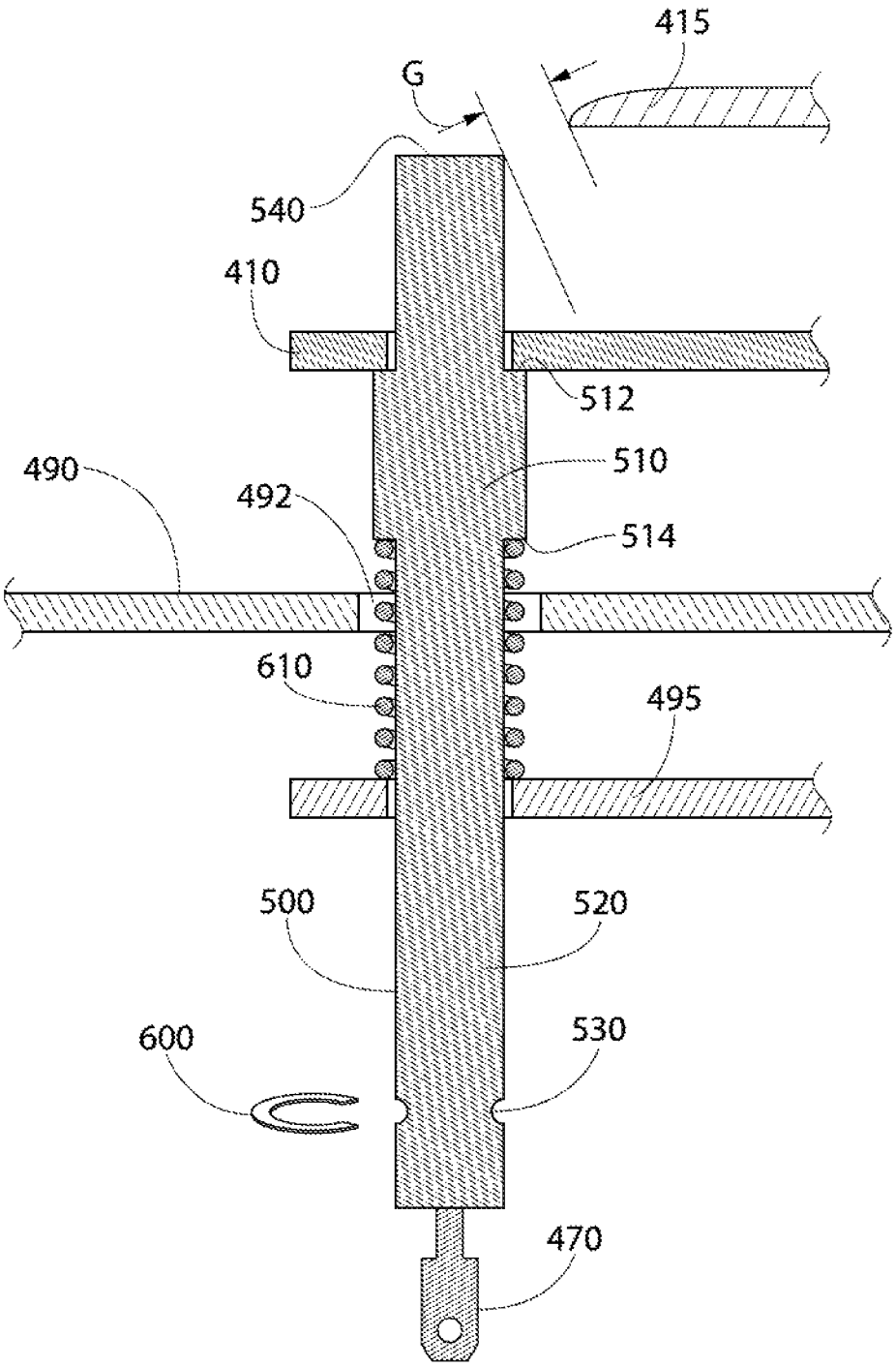
FIG. 7 is a partial sectional view of a cooktop in accordance with embodiments of the invention where the cooktop is in an assembled state.

FIGS. 6 and 7 show another exemplary configuration of embodiments. In this configuration, top 540 of igniter 500 is not directly vertically below burner head 415. As shown in FIG. 6, head 540 of igniter 500 is located horizontally between two legs of five star legs of burner head 415. While a star shaped burner head is shown in this example, other shaped burner heads can be used.

FIG. 7 is similar to FIG. 5, except that spark gap G between burner head 415 and top 540 of igniter 500 is angled relative to vertical. This is the condition that would exist in a configuration such as that shown in FIG. 6.

Both FIG. 5 and FIG. 7 show examples of the position of igniter 500 when the cooktop is in an operating condition with top sheet 490 and burner body 410 in place in the operating condition. In these Figures, spring 610 is in a more compressed state than when top sheet 490 and burner body 410 are not in place in the operating condition (described below).

Figure 8:
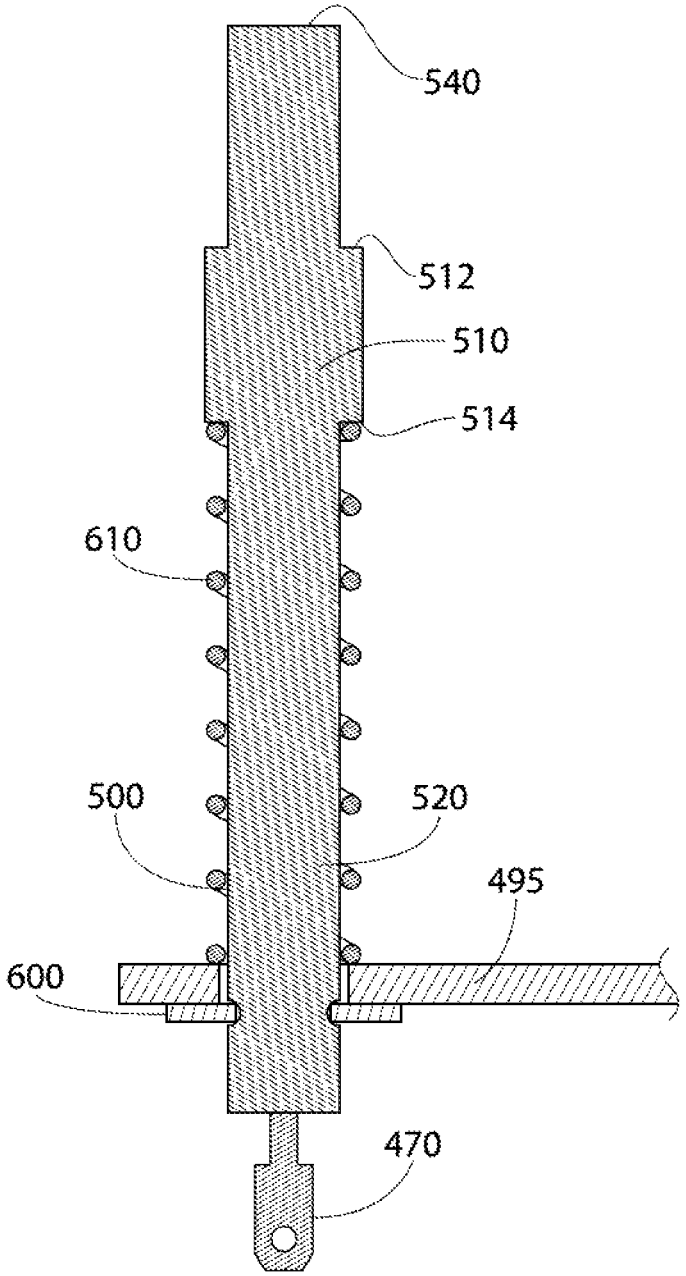
FIG. 8 is a partial sectional view of a cooktop in accordance with embodiments of the invention where the cooktop is in a partially assembled state.

FIG. 8 shows the position of igniter 500 when top sheet 490 and burner body 410 are not in the operating position. In this condition, spring 610 pushes igniter 500 upward until clip 600 contacts a lower surface of lower burner mounting structure 495 and stops any further upward movement of igniter 500. This feature is extremely helpful during assembly of the cooktop because igniter 500 can be assembled to lower burner mounting structure 495 and held in place by clip 600 while the necessary wires are connected to electrical connection 470. All of the igniters in the cooktop (often five or six) can be assembled in this manner before top sheet 490, with attached burner bodies 410, is put in place on the cooktop lower structure. As top sheet 490 with burner bodies 410 is lowered into position on the cooktop lower structure, the head 540 of each igniter 500 will protrude though the appropriate hole in the associated burner body 410 until the lower surface of each burner body 410 comes into contact with the top ledge 512 of stop 510 of its associated igniter 500. At this point, igniters 500 will be in the precise operating position, as shown in FIGS. 5 and 7. Spring 610 is sufficiently strong to press igniter 500 upward to firmly contact the lower surface of the burner body 410 while, at the same time, is not too strong to prevent top sheet 490 from moving sufficiently downward to rest in the operating position.

As can be seen in the above exemplary embodiments, the invention provides a solution to problems associated with igniters that are attached to a burner body prior to the top sheet being installed onto the cooktop lower structure, and problems associated with igniters that are press fit into mounting brackets.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention. In addition, all combinations of any and all of the features described in the disclosure, in any combination, are part of the invention.

What is claimed is:

1. A burner assembly for a domestic gas cooktop having a top sheet, the burner assembly comprising:

a lower burner mounting structure configured to be positioned on a first side of the top sheet;

a burner body configured to be positioned on a second side of the top sheet, the second side of the top sheet, being opposite the first side of the top sheet, the burner body having an igniter positioning surface;

an igniter having an igniter end, and a stop integrally formed in the igniter, the stop having an upper ledge; and an urging member that pushes against the lower burner mounting structure, and urges the igniter in a direction away from the lower burner mounting structure and toward the igniter positioning surface of the burner body such that the upper ledge of the stop is urged into contact with the igniter positioning surface of the burner body when the burner assembly is in an assembled condition, wherein the igniter is held in an operating position by the burner body and the urging member when the burner assembly is in use; and wherein the igniter is held in a vertically limited position by the urging acting on the lower burner mounting structure when the burner assembly is in an unassembled condition, the vertically limited position being a position at which movement of the igniter in a direction away from the lower burner mounting structure is restrained.

2. The burner assembly of claim 1, wherein the burner body further comprises a burner head positioning surface configured to locate a burner head such that a specific spark gap exists between the burner head and the igniter end.

3. The burner assembly of claim 2, wherein a distance between the burner head positioning surface of the burner body and the igniter positioning surface of the burner body is fixed.

4. The burner assembly of claim 3, further comprising the burner head.

5. The burner assembly of claim 4, wherein the specific spark gap is measured along a direction that has only a vertical component.

6. The burner assembly of claim 4, wherein the specific spark gap is measured along a direction that has both a vertical component and a horizontal component.

7. The burner assembly of claim 3, wherein the urging member presses against a lower ledge of the stop.

8. The burner assembly of claim 3, further comprising a retaining element, wherein the igniter further comprises a notch configured to receive the retaining element, the notch being located on the igniter in a position below the lower burner mounting structure, and the retaining element prevents vertical movement of the igniter when the retaining element contacts the lower burner mounting structure.

9. The burner assembly of claim 3, wherein the urging member is in a first compressed state when the burner assembly is in the unassembled condition, and the urging member is in a second compressed state when the burner assembly is in use, the second compressed state being more compressed than the first compressed state.

10. A domestic gas cooktop, comprising:

a top sheet;

a gas manifold below the top sheet; and a burner assembly having a lower burner mounting structure positioned on a first side of the top sheet, a burner body positioned on a second side of the top sheet, the second side of the top sheet being opposite the first side of the top sheet, the burner body having an igniter positioning surface, an igniter having an igniter end and a stop integrally formed in the igniter, the stop having an upper ledge, and an urging member that pushes against the lower burner mounting structure, and urges the igniter in a direction away from the lower burner mounting structure and toward the igniter positioning surface of the burner body such that the upper ledge of the stop is urged into contact with the igniter positioning surface of the burner body when the burner assembly is in an assembled condition, wherein the igniter is held in an operating position by the burner body and the urging member when the domestic gas cooktop in use; and wherein the igniter is held in a vertically limited position by the urging member acting on the lower burner mounting structure when the burner assembly is in an unassembled condition, the vertically limited position being a position at which movement of the igniter in a direction away from the lower burner mounting structure is restrained.

11. The domestic gas cooktop of claim 10, wherein the burner body further comprises a burner head positioning surface configured to locate a burner head such that a specific spark gap exists between the burner head and the igniter end.

12. The domestic gas cooktop of claim 11, wherein a distance between the burner head positioning surface of the burner body and the igniter positioning surface of the burner body is fixed.

13. The domestic gas cooktop of claim 12, further comprising the burner head.

14. The domestic gas cooktop of claim 13, wherein the specific spark gap is measured along a direction that has only a vertical component.

15. The domestic gas cooktop of claim 14, wherein the specific spark gap is measured along a direction that has both a vertical component and a horizontal component.

16. The domestic gas cooktop of claim 12, wherein the urging member presses against a lower ledge of the stop.

17. The domestic gas cooktop of claim 12, further comprising a retaining element, wherein the igniter further comprises a notch configured to receive the retaining element, the notch being located on the igniter in a position below the lower burner mounting structure, and the retaining element prevents vertical movement of the igniter when the retaining element contacts the lower burner mounting structure.

18. The domestic gas cooktop of claim 12, wherein the urging member is in a first compressed state when the burner assembly is in the unassembled condition, and the urging member is in a second compressed state when the burner assembly is in use, the second compressed state being more compressed than the first compressed state.

* * * * *